United States Patent [19]

Aoki et al.

[11] Patent Number: 4,980,258

[45] Date of Patent: Dec. 25, 1990

[54] DRY TYPE DEVELOPER FOR ELECTROPHTOGRAPHY

[75] Inventors: Mitsuo Aoki, Numazu; Nobuhiro Nakayama, Susono; Yasuo Asahina, Numazu; Hiroyuki Fushimi, Numazu; Kayo Makita, Numazu; Yasuaki Iwamoto, Numazu, all of Japan

[73] Assignee: Ricoh Company, Ltd., Tokyo, Japan

[21] Appl. No.: 436,551

[22] Filed: Nov. 14, 1989

[30] Foreign Application Priority Data

Nov. 17, 1988 [JP] Japan ..... 63-290635

[51] Int. Cl.[5] ..... G03G 9/00

[52] U.S. Cl. ..... 430/110; 430/108

[58] Field of Search ..... 430/110, 108

[56] References Cited

U.S. PATENT DOCUMENTS 4,590,141 5/1986 Aoki et al. ..... 430/108

4,826,749 5/1989 Kawagashi et al. ..... 430/110

*Primary Examiner*—Marion E. McCamish

*Assistant Examiner*—S. Crosson

*Attorney, Agent, or Firm*—Cooper & Dunham

[57] ABSTRACT

The present invention relates to the positively chargeable black toner particles which comprise binder resins, carbonblack as a main colorant, quaternary anmonium salt of the following formula (I) as a charge control agent and $\beta$-form Cu-phthalocyanine as a stabilizing agent for chargeability of toner particles without being affected by the change of environmental conditions.

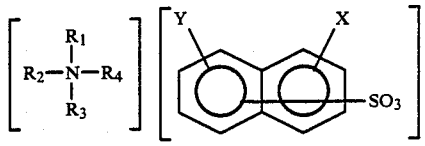

(I)

Wherein $R_1$ is $C_1$–$C_8$ alkyl or benzyl, $R_2$ and $R_3$ are each $C_1$–$C_{18}$ alkyl, R is $C_1$–$C_{118}$ alkyl or benzyl, X is hydroxy or amino, and Y is hydoroxy or hydrogen; (c) $\beta$-form Cu-phthalocyanine; and (d) carbonblack.

The present invention further relates to the two component dry-type developer composed by the improved above said positively chargeable toner particles and the carrier particles coated with silicone polylmers which have the strong durability without being changed to a supent carrier particles for a use of long time period.

13 Claims, No Drawings

DRY TYPE DEVELOPER FOR ELECTROPHTOGRAPHY

BACKGROUND OF THE INVENTION

The present invention relates to a dry toner for developing electrostatic latent images to visible images, for useing electrophotography, electrostatic recording methods and electrostatic printing methods.

Conventionally, as a developer for use in these fields, a so called two-component dry-type developer is well known, which comprises carrier particles and toner particles. In the two-component dry-type developer, particle size of the toner particles is much smaller than that of the carrier particles, and the toner particles are triboelectrically attracted to the carrier particles and held on the surface of the carrier particles. Electric attraction between the toner particles and the carrier particles is caused by friction between the toner paraticles and the carrier particles. When the toner particles, which are held on the carrier particles, are brought near or into contact with the latent electrostatic images, electric fields of the latent electrostatic images work on the toner paraticles to separate the toner particles from the carrier particles, to overcome the bonding attraction between the toner particles and the carrier particles. As a result, the toner particles are attracted towards the latent electrostatic images in an ordinary case, or repulsed by the latent electrostatic images in the case of a reversal development, and the latent electrostatic images are thus developed to the visible images.

In the case of the two-component dry-type developer, only the toner particles are consumed as the development is performed. Therefore, it is necessary to replenish the toner particles in a course of the repeated development by a developing apparatus. Further, the carrier particles are required to charge the toner particles triboelectrically in such a way that the toner particles have desired polarity and a sufficient amount of charges for a long period of time during use.

In the case of the conventional two-component dry-type developer, it is apt to occur that resins contained in and released from the toner particles in course of a mechanical mixing of the toner particles and the carrier particles in the developing apparatus, eventually cover surfaces of the carrier particles. Once surfaces of the carrier particles are covered with resins, which are referred to as a "spent phenomenon", such particles no longer function as active carrier particles, that is, the carrier particles which contribute to the development. As a result, charging characteristics of the carrier particles in the conventional two-component dry-type developer deteriorate with the time in use. In the end, it is necessary to replace an entire developer by a new developer.

In order to prevent the spent phenomenon, a method of coating the surface of carrier particles with any of several different resins has been proposed.

In an ordinary case, the latent electrostatic images with positive charges on a photoconductor as in the case of an amorphous selenium photoconductor are developed by negatively charged toner particles, and latent electrostatic images with negative charges on a photoconductor as in the case of an organic photoconductor are developed by a positive charged toner particles. In the case of reversal development, the electrostatic latent images with positive charges are developed by positively charged toner particles, and latent electrostatic images with negative charges are developed by negatively charged toner particles.

The resin overcoated on the surface of the carrier particles must be selected so as to prevent the spent phenomenon, and to toriboelectrically charge the carrier particles to desired polarity. For instance, in case of carrier particles coated with fluorocarbon polymers, of which surface enegy is 10~15 dyne/cm and extremly low compared with other resins, the spent phenomenon occurs only slightly. However, since fluorocarbon polymers are on extremely negative side in terms of triboelectric charging series, carrier particles coated with fluorocarbon polymers can be only used for the toner particles which are to be charged to positive polarity.

In case of carrier particles coated with silicone polymers, of which surface enegy is 23~28 dyne/cm, the spent phenomenon occurs only slightly as the carrier particles coated with fluorocarbon polymers. Furthermorer, silicone polymers are on more positive side than fluorocarbon polymers in terms of totriboelectric charging series. Therefore, as disclosed in U.S. Pat. No. 4,584,254, (issued Apr. 22. 1986) the carrier particles coated with the silicone polymers can be used to both positively chargeable toner particles and negatively chargeable toner particles, and a successful scale merit can be expected for a mass production of the carrier particles coated with the silicone polymers.

As a curing condition of silicone polymer of which curing temperature is from 20° C. (room temperature) to 200° C. and is considerably lower when compared to 350° C. for the fluorocarbon polymers, production of carrier particles coated with silicone polymers is considered to be inexpensive.

Furthermore, it is indispensable to reduce particle size of carrier particles, whose conventional size is 50~250 μm, in order to improve quality of the developed image. In order to prevent the spent phenomenon to the toner particles of the reduced size it is necessary to be coated with a thin resin film on the surfaces of the carrier particles, and the silicone polymers are most suitable for this purpose.

However, this useful carriers coated with the silicone polymers have a defect that an ability of charging a sufficient amount of charges to the toner particles is inferior to the carrier coated with the fuluorocarbon polymers. Then, in order to use the carriers coated with silicone polymers together with the positively chargeable toner particles as the two component dry-type developer, many properties respect to chargeability of toner particles must be improved, such as a positive chargeability, a narrow charge distribution range of toner particles, running durability for a long time of period, short triboelectric charging time to charge a sufficient amount of charges for the toner particles, and maintenance of a toner charge level under widely varing environmental conditions, especially varing rerative humiditiy (R.H) conditions.

To enable the toner particles to retain the charge, it is proposed to utilize the triboelectric chargeability of polymers used as a main component of the toner particles, but the so adapted is low in chargeability, and the toner images obtained are apt to be fogging and obscure.

Then, an another method, in which a charge control agent is used for triboelectrically charging toner particles to the desired polarity and to the sufficient amount of charges, has been proposed.

As the charge control agents for giving positive chargeability, Olson (U.S. Pat. No. 3,647,696 issued Mar. 7. 1972) describes organic acidnigroshine salt, and Jacknow et. al., (U.S. Pat. No. 3,577,354 issued Mar. 4. 1971), describes a solid metal salt of a higher fatty acid. However, adhesion of fixed images to a suitable receiving sheet by the toner particles modified with the such organic salts is weak, and the such organic salts are apt to change the chemical quality, when the toner particles are triboelectorically charged by the carrier particles, and as a result the chargeability of the toner particles are decreased. Thomas et. al. (U.S. Pat. No. 3,893,935 issued Jul. 8. 1975) describes quaternary anmonium salt having long chain aliphatic hydrocarbons for the positive charge control agents. Even if toner particles incorporated with the above mentioned control agents have the high chargeability, it changes with environmental conditions, esecially with high temperature and high humidity conditions.

To overcome these defects of such quaternay anmonium salt, modifications of chemical structurs of quaternary anmonium salt have been proposed, such as an azoniabicyclooctanate (Burness et. al. U.S. Pat. No. 4,079,014 issued Mar. 14. 1975), organic quaternary anmonium sulfonate and sulphate (Lu et. al., U.S. Pat. No. 4,338,390 issued Jul. 6. 1982), alkyl pyridinium salt (Lu et. al., U.S. Pat. No. 4,298,672 issued Nov. 3. 1981), quatenary anmonium inner molecular salt (Barbett et. al., U.S. Pat. No. 4,752,550 issued Jun. 21. 1988), improved organic quaternary anmonium sulfonate (Kawagishi et. al., Japanese Laid-Open Pat. App. No. 60-169857 issued Sep. 3. 1985, App. No. 62-3259 issued Jan. 9. 1987, and App. No. 62-71968 issued Apr. 2. 1987). Although there are so many discriptions about improvements of the chargeability for the environmental conditions such as high temperature and high humidity in the above mentioned literatures, almost of the modified toner particles comprising proposed quaternary anmonium salt are combined with the carrier particles coated with fluorocarbon polymers which are on extremely negative side in terms of totriboelectric charging series.

When above mentioned modified toner particles are combined with the carrier particles coated with the silicone polymers which are a little more hydrohobic than the fluorocarbon polymers, chargeability of the toner particles change with widely varing environmental conditions. For example, in case of conditions of high temperature, and high humidity an amount of charges are decreased, and some defects are arised such as deposition of toner particles on a back ground, deterioration of resolution of developed images, separation of toner particles from the carrier particles. On the other hand, in case of conditions at low temperature and low humidity, some another defects are arised such as decreasement in image density, empashyses of edge efects, where only edges of latent electrostatic images are developed and solid area can not be developed perfectly.

Such shortcomings tend to be intesified when carbonblack having low electric resistivity ($10^3 \sim 10^6 \Omega cm$) is used as a colorant in the toner particles.

SUMMARY OF THE INVENTION

It is therefore an object of the present invention to provide black toner particles which are capable to be positively charged for use in a two component dry-type developer for developing electrostatic latent images to visible images.

Another object of the present invention is to provide black toner particles having improved triboelectrical chargeability with carrier particles, even if in the use of long period of time.

Another object of the present invention is to provide a toner composition in which a stabilizing agent for improving chargeability of the toner particles is added to a composition comprising binder resins, carbonblack and a charge control agent, for the sake of retaining a high charging performance without being affected by changes of environmental condition, such as change of temperature and humidity.

The above objects of the present invention are attained by a use of black toner particles which comprise a binder resin, carbonblack as a colorant, quaternary anmonium salt of the following formula (I) as a charge control agent and β-form Cu-phthalocyanine as a stabilizing agent for improving chargeability of toner particles.

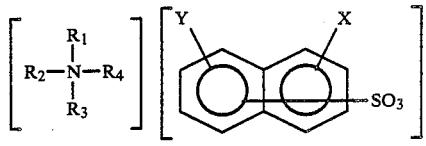

(I)

Wherein $R_1$ is $C_1$–$C_8$ alkyl or benzyl, $R_2$ and $R_3$ are each $C_1$–$C_{18}$ alkyl, R is $C_1$–$C_{18}$ alkyl or benzyl, X is hydroxy or amino, and Y is hydoroxy or hydrogen; (c) β-form Cu-phthalocyanine; and (d) carbonblack.

A futher object of the present invention is to provide to the two component dry-type developer comprising the improved above mentioned positively chargeable toner particles and the carrier particles coated with silicone polylmers which can be in use for a long time period without changing to spent carrier particles.

DETAILED DESCRIPTION OF THE INVENTION

This invention relates to positively chargeable toner particles for use developing a latent electrostatic images which comprise a binder resin, carbonblack as a colorant, quaternary anmonium salt and β-form Cu-phthalocyanine.

In order to eliminate defects that chargeability of toner particles, comprising binder resins, carbonblack as a colorant, quaternary anmonium salt, are affected by change of environmental condition, such as change of temperature and humidity, β-form Cu-phthalocyanine is added to the above composition of toner particles as a stabilizing agent.

A composition of toner particles in the present invention is as follows;

(1) a binder resin
(2) quaternary anmonium salt of the folloing formula (I)
(3) β-form Cu-phthalocyanine
(4) carbonblack Furthermore, this invention relates to the two component dry-type developer comrising the toner particles with above mentioned toner composition and the carrier particles of which surfaces are overcoated with silicon polymers.

A chemical structure of Cu-phthalocyanine is polymorphism, and several kinds of crystalline structures are known and each crystalline structure of Cu-phthalocyanines is characterized by an absorption spectrum of ultraviolet, visible and infrared rays, and diffraction by X rays.

Among the several kinds of crystalline structure of Cu-phthalocyanine, two kinds, α-form Cu-phthalocyanine and β-form Cu-phthalocyanine are available in a market. According to the Colur Index, Pigment Blue 15, 15:1 and 15:2 are stated as α-form Cu-phthalocyanine, and Pigment Blue 15:3 and 15:4 as β-form Cu-phthalocyanine. β-form Cu-phthalocyanine used in the present invention, is Pigment Blue 15:3 or 15:4.

Although reasons why β-form Cu-phthalocyanine is so effective as a stabilizing agent for chargeability of toner particles are unknown in this stage, it is considered to be some following factors.

(1) The crystalline structure of β-form Cu-phthalocyanine is more stable than that of α-form Cu-phthalocyanine, and structure of α-form Cu-phthalocyanine gradually changes to that of β-form Cu-phthalocyanine with the lapse of time.

(2) Wetability of β-form Cu-phthalocyanine is superior to that of α-form Cu-phthalocyanine, and then β-form Cu-phthalocyanine could be so finely dispersed into binder resins of toner particles that chagreability of toner particles comprising β-form Cu-phthalocyanine would be stable for change of environmental conditions.

(3) Chemical activity of making salt with chemicals of β-form Cu-phthalocyanine is superior to that of α-form Cu-phthalocyanine, and it is surposed to be some chemical interraction between β-form Cu-phthalocyanine and quaternary anmonium salt.

Examples of binder resins in the present invention include series of styrenic resins (mono-,co-,ter- polymer including styrene and styrene derivatives) such as polystyrene, polychlorostyrene, poly-α-methylstyrene, copolymer of styrene and chlorostyrene, copolymer of styrene and propyrene, copolymer of styrene and butadiene, copolymer of styrene and vinylchloride, copolymer of styrene and vinylacetate, copolymerof styrene and maleicacid, copolymer of styrene and acrylate (styrene and methylacrylate, styrene and ethylacrylate, styrene and buthylacrylate, styrene and octylacrylate, styrene and phenylacrylate, etc.), copolymer of styrene and methacrylate (styrene and methymethacrylate, styrene and ethylmethacrylate, styrene and buthylmethacrylate, styrene and phenlymethacrylate, etc.), copolymer of styrene and methyl-α-chloroacrylate, terpolymer of styrene acrylonitril and acrylate, vinyl resins, rosin modified maleicacid resins, phenyl resins, epoxy resins, polyester resins, low molecular weight polyethylene resins, low molecular weight polypropyrene resins, polyurethane resins, silicone resins, ketone resins, copolymer of ethylene and ethylacryrate, xylene resins, polyvinylbutyral resins, etc.

Each of these polymers can be use singly, or together with each other. There are no limitations in production metods for polymers, and any method of bulk polymerization, solution polymerization, emulsion polymerization and suspension polymerization can be applied to make above mentioned polymers.

Examples of quaternary anmonium salt of the formula (I) as a charge control agent are shown in table 1.

TABLE 1

| No. | Charge control agents of quaternary anmonium salt chemical formulation |
|---|---|
| 1 | 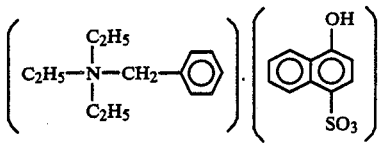 |
| 2 | 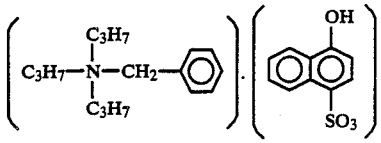 |
| 3 | 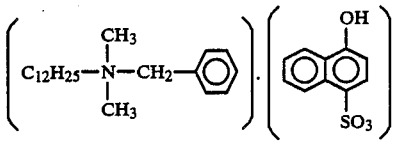 |
| 4 | 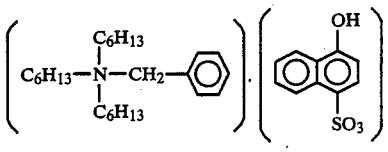 |
| 5 | 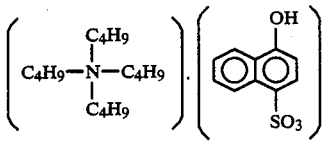 |
| 6 | 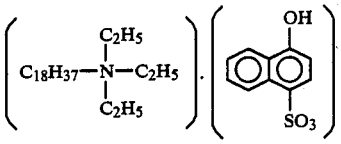 |
| 7 | 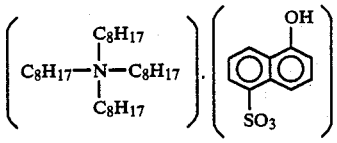 |
| 8 | 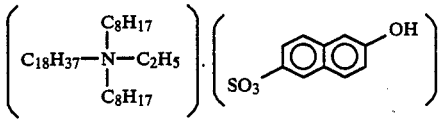 |
| 9 | 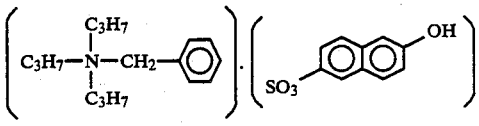 |

TABLE 1-continued

| No. | Charge control agents of quaternary anmonium salt chemical formulation |
|---|---|
| 10 | 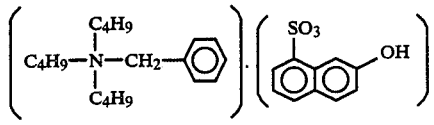 |
| 11 | 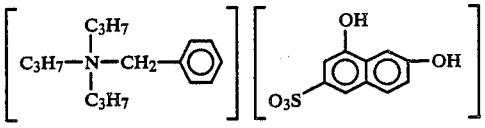 |
| 12 | 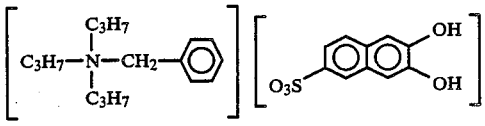 |
| 13 | 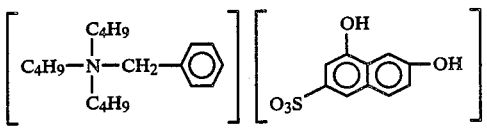 |
| 14 | 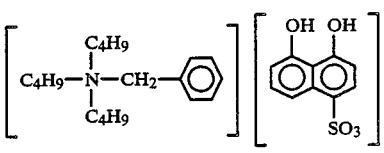 |
| 15 | 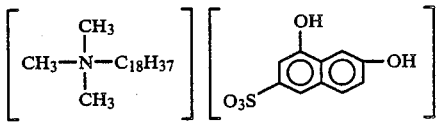 |
| 16 | 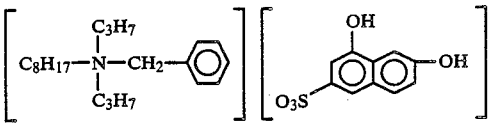 |
| 17 | 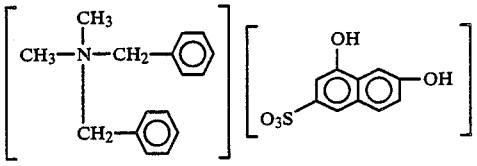 |
| 18 | 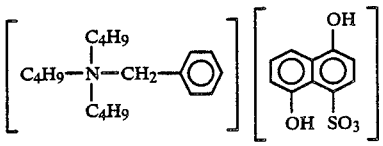 |
| 19 | 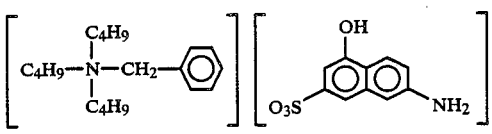 |

TABLE 1-continued

| No. | Charge control agents of quaternary anmonium salt chemical formulation |
|---|---|
| 20 | 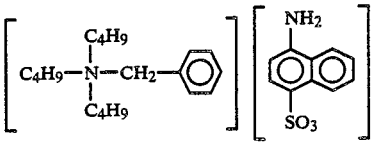 |
| 21 | 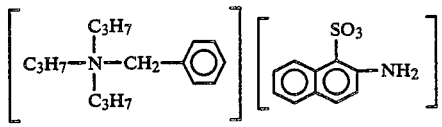 |
| 22 | 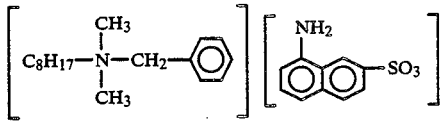 |
| 23 | 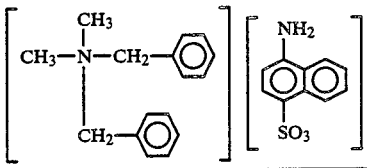 |

It is preferable that an amount of quaternary anmonium salt is in the range of 0.05 to 10 parts by weight with respect to an entire amount of binder resin component contained in the toner particles.

Cu-phthalocyanine in the present invention is shown as a following formula (II), of which cristalline structure is a $\beta$-form. According to the Colour Index, Pigment Blue 15:3 and Pigment Blue 15:4 belong to $\beta$-form Cu-phthalocyanine.

(II)

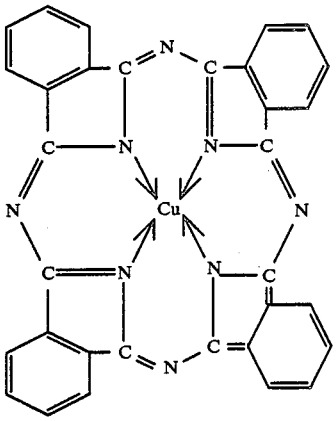

($\beta$-form)

Concreate examples $\beta$-form Cu-phthalocyanine include such as Lionol Blue FG-7330, FG-7350, FG-7351, FG-7345, FG-7391G, FG-7393G, FG-7394G, No. 700-8FG Cyanine Blue and No. 700-10FG Cyanine Blue (which are made by ToyoInk Co., Tokyo, Japan), Cyanine Blue FGF, TGR and KRN (which are made by Sanyo Shikiso Co., Osaka, Japan), Cromofine Blue 4920., 4927, KBN and 4930 (which are made by Dainchi Seika Co., Tokyo, Japan).

It is preferable that a amount of β-form Cu-phthalocyanine is in the range of 0.1 to 5 parts by weight with respect to the entire amount of binder resin component contained in toner particles.

Any known of carbonblack such as furnace black, acetylene black and thermal black can be used.

It is preferable that carbonblack is in the range of 1.0 to 15 parts by weight with respect to an entire amout of binder resin component contained in the toner particles.

The above mentioned ingredients for the toner particles are uniformely mixed together by a ball mill or a blender to prepare a premix, which are kneaded by a kneader or heat rolls in a molten state, cooled, then roughly grounded by a vibrating mill and further pulverized by a jet mill, then fine particles obtained were classified to obtain the toner particles with a desired particle size range.

As a silicone resin for use in the silicone resin layer of the carrier particles, any of conventional silicone resins can be used. In particular, a room-temperature setting-type silicone resin of the following general formula (III) is preferable for use in the present invention.

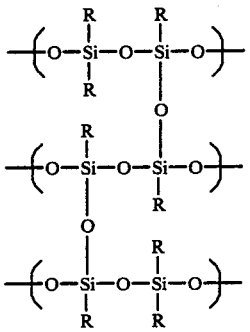

(III)

wherein R represent hydrogen, halogen, a hydroxy group, a methoxy group, a lower alkyl group with 1 to 4 carbon atoms, or a phenyl group.

Following silicone resins are commercially available, such as KR271, KR255 and KR152 made by Shin-Etsu chemical Co., Ltd., Tokyo, Japan; and silicone resins SR2400, SR2406 and SH840 made by Toray Silicone Co., Ltd., Tokyo, Japan.

As core materials of the carrier particles which are coated with the above described silicone resins, metalic or non-metalic particles with average particle size ranging from 20 μm to 1000 μm, preferably ranging from 50 μm to 250 μm, such as particles of cobalt, iron, iron oxide, copper, nickel, zinc, alminium, brass or glass can be employed.

Silicone resins can be coated on the core material by conventional procedures, for instance, by dissolving a silicone resin in an organic solvent and spraying a resin solution on the core particles.

It is preferable that thus prepared toner particles are mixed with the carrier partaicles in such an amount as to cover 30% to 90% of the silicone coated surface of the carrier particles.

Referring to following examples, embodiment of toner particles, and the developer composed by the toner particles and the carrier particles according to the present invention will now be explained in detail.

EXAMPLE 1

Toner composition of Toner No. 1

| Component | Parts by weight |
|---|---|
| Binder resin: polystyrene D-125 (made by Esso Petroleum Chem. Co.) | 87.0 |
| Quternary anmonium salt: | 2.0 |
| 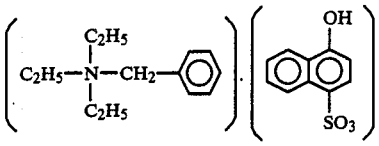 | |
| β-form Cu-phythalocyanine: Lionol Blue FG-7350 (made by ToyoInk Co. Tokyo, Japan) | 3.0 |
| Carbonblack: Carbonblack #44 (made by MItsubishi-Kasei. Co. Tokyo, Japan) | 10.0 |

The above components were mixed, kneaded by heat rolls, crushed and classified under conventional procedures, so that toner particles with volume mean average diameter of 10 μm (measured by the Coulter Counter Model TA-II). The toner particles were called as Toner No. 1.

In order to compare the stable chargeability of toner particles comprising β-form Cu-phythalocyanine with that of α-form Cu-phythalocyanine, comparative toner particles were prepared in which, instead of Lionol Blue FG-7350, Cyanine Blue MG-5(α-form Cu-phythalocyanine made by ToyoInk Co. Tokyo, Japan) were used. This toner particles were called as Comparative Toner No. 1.

With a use of above mentioned two kinds of toner particles, the environment dependency of the triboelectrical chargeability of toner particles with carrier particles (how much an amount of charges on toner particles change by variation of environmental condition, such as change of temperature and humidity) was measured by a following method. In this measurement, iron carrier particles TEFV200/300 of which surface had no coatings of resins (made by Nihon Iron Powder Co., Tokyo, Japan) were in use.

Method for measurement of environment dependency of the triboelectrical chargeability of toner particles (1) Definition of a rate of environment dependency of the triboelectrical chargeability of toner particles.

The environment dependency of the toner particles was defined as the rate of change of between Q/M (μ coulomb/g) at low temperature and low humidity and Q/M at high temperature and high humidity, where Q/M (μ coulomb/g) is an amount of charges per unit weight of toner particles when the toner particles and the carrier particles were mixed to be triboelectrically charged.

$$\text{Rate of change of } Q/M\ (\%) = \frac{Q/M \text{ at low} - Q/M \text{ at high}}{Q/M \text{ at low}} \times 100$$

where Q/M at low was Q/M at low temperature and low humidity, and Q/M at high was Q/M(μ coulomb/g) at high temperature and high humidity.

(2) A metohd for the measurement of Q/M at low temperature and low humidity.

3.0 g of toner particles and 97.0 g of carrier particles were kept in an environmental condition such as 10° C. and 20% relative humidity(RH) for 3 hours. After that, the toner particles and the carrier particles were transfered into a pot made of steel and mixed to be charged by triboelectrification for 10 minutes, and then Q/M were measured by a blow off method.

(3) A metohd for the measurment of Q/M at high temperature and high humidity.

3.0 g of toner particles and 97.0 g of carrier particles were kept in an environmental condition such as 30° C. and 85% relative humidity(RH) for 3 hours. After that, by the same way as the above mentioned triboelectrification Q/M were measured.

Results of the mesurements were as follows.

| Toner No. | Q/M(μcoulomb/g) 10° C. and 20% RH | 30° C. and 85% RH | Rate of Change of Q/M (%) |
|---|---|---|---|
| Toner No. 1 | 21.5 | 20.5 | 2.8 |
| Comparative Toner No. 1 | 22.1 | 14.4 | 34.8 |

As shown in the above result, the rate of change of Q/M of the presented toner particles comprising β-form Cu-phythalocyanine to the change of environmental coditions is very small compared with the toner comprising α-form Cu-phythalocyanine.

EXAMPLE 2

| Toner composition of Toner No. 2 | |
|---|---|
| Component | parts by weight |
| Binder resin: copolymer of styrene-n-buthylmethacrylate | 86.5 |
| Quternary anmonium salt: | 0.5 |

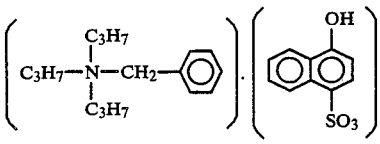

| | |
|---|---|
| β-form Cu-phythalocyanine: Fastogen Blue FGF (made by DainihonInk Co., Tokyo, Japan) | 3.0 |
| Carbonblack: Carbonblack #44 (made by MItsubishi Kasei, Tokyo, Japan) | 10.0 |

By the same procedures as in the case of the Toner No. 1, toner particles of the above composition were prepared (Toner No. 2).

In order to compare the stable chargeability of toner particles comprising β-form Cu-phythalocyanine with that of α-form Cu-phythalocyanine, comparative toner particles (Comparative Toner No. 2) were prepared in which, instead of Fastogen Blue FGF, Fastogen Blue GP(α-form Cu-phythalocyanine made by DainihonInk Co. Tokyo, Japan) was used.

With the the use of above mentioned two kinds of toner particles, the environment dependency of the triboelectrical chargeability of toner particles was measured by the same way as Example 1, and results of measurements were as follows.

| Toner No. | Q/M(μcoulomb/g) 10° C. and 20% RH | 30° C. and 85% RH | Rate of Change of Q/M (%) |
|---|---|---|---|
| Toner No. 2 | 18.2 | 18.0 | 1.1 |
| Comparative Toner No. 2 | 17.5 | 11.4 | 34.9 |

As shown in the above result, the rate of change of Q/M of the presented toner particles comprising β-form Cu-phythalocyanine to the change of environmental coditions is very small compared with the toner particles comprising α-form Cu-phythalocyanine.

EXAMPLE 3

| Toner composition of Toner No. 3 | |
|---|---|
| Component | parts by weight |
| Binder resin: copolymer of styrene-n-buthylmethacrylate | 87.5 |
| Quternary anmonium salt: | 2.0 |

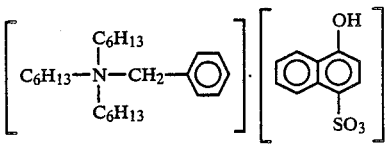

| | |
|---|---|
| β-form Cu-phythalocyanine: Lionol Blue FG-7391G (made by ToyoInk Co. Tokyo. Japan) | 0.5 |
| Carbonblack: Carbonblack #44 (made by Mitsubishi-Kaseio. Tokyo. Japan) | 10.0 |

By the same procedures as in the case of the Toner No. 1, toner particles of the above composition were prepared (Toner No. 3).

Comparative toner particles (Comparative Toner No. 3) were prepared in which, instead of Lionol Blue FG-7391G, Cyanine Blue MR-4 (α-form Cu-phythalocyanine made by DainihonInk Co. Tokyo, Japan) was used.

With the the use of above mentioned two kinds of toner particles, the environment dependency of the triboelectrical chargeability of toner particles was measured by the same way as Example 1, and results of measurements were as follows.

| Toner No. | Q/M(μcoulomb/g) 10° C. and 20% RH | 30° C. and 85% RH | Rate of Change of Q/M (%) |
|---|---|---|---|
| Toner No. 3 | 26.4 | 25.7 | 2.8 |
| Comparative Toner No. 3 | 26.8 | 14.2 | 46.5 |

As shown in the above result, the rate of change of Q/M of the presented toner particles comprising β-form cu-phythalocyanine to the change of environmental coditions is very small compared with the toner comprising α-form Cu-phythalocyanine.

EXAMPLE 4

| Toner composition of Toner No. 4 | |
|---|---|
| Component | parts by weight |
| Binder resin: Polystyren D-125; | 91.0 |

-continued

Toner composition of Toner No. 4

| Component | parts by weight |
|---|---|
| (made by Esso Petroleum Chem., Co.) | |
| Quternary anmonium salt: | 1.5 |

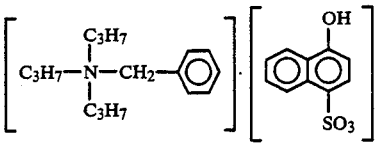

| | |
|---|---|
| β-form Cu-phythalocyanine: | 0.5 |
| Lionol Blue FG-7351 | |
| (made by ToyoInk Co., Tokyo, Japan) | |
| Carbonblack: | 7.0 |
| Carbonblack #44 | |
| (made by Mitsubishi Kasei, Tokyo, Japan) | |

By the same procedures as in the case of the Toner No. 1, toner particles of the above composition were prepared (Toner No. 4).

In order to compare the stable chargeability of toner particles comprising β-form Cu-phythalocyanine with that of α-form Cu-phythalocyanine, comparative toner particles (Comparative Toner No. 4) were prepared in which composition Lionol Blue FG-7351 was eliminated from Toner No. 4.

With the use of above mentioned two kinds of toner particles, the environment dependency of the triboelectrical chargeability of toner particles was measured by the same way as Example 1, and the results of measurements were as follows.

| Toner No. | Q/M(μcoulomb/g) 10° C. and 20% RH | 30° C. and 85% RH | Rate of Change of Q/M (%) |
|---|---|---|---|
| Toner No. 4 | 18.2 | 18.0 | 1.1 |
| Comparative Toner No. 4 | 17.5 | 11.4 | 34.9 |

As shown in the above result, the rate of change of Q/M of the presented toner particles comprising β-form Cu-phythalocyanine under change of environmental coditions is very small compared with the toner particles which are without comprising β-form Cu-phythalocyanine.

EXAMPLE 5

Toner composition of Toner No. 5

| Component | parts by weight |
|---|---|
| Binder resin: | 87.0 |
| Polystyren D-125; | |
| (made by Esso Petroleum Chem. Co.) | |
| Quternary anmonium salt: | 1.0 |

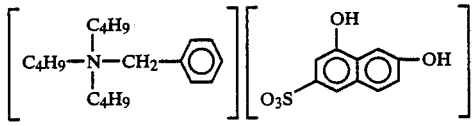

| | |
|---|---|
| β-form Cu-phythalocyanine: | 2.0 |
| Lionol Blue FG-7393G | |
| (made by ToyoInk Co. Tokyo. Japan) | |
| Carbonblack: | 10.0 |
| Carbonblack #44 | |

-continued

Toner composition of Toner No. 5

| Component | parts by weight |
|---|---|
| (made by Mitsubishi Kasei, Tokyo, Japan) | |

By the same procedures as in the case of the Toner No. 1, toner particles of the above composition were prepared (Toner No. 5).

With the the use of the above mentioned toner particles, the environment dependencey of the triboelectrical chargeability of toner particles was measured by the same way as Example 1, and results of measurements were as follows.

| Toner No. | Q/M(μcoulomb/g) 10° C. and 20% RH | 30° C. and 85% RH | Rate of Change of Q/M (%) |
|---|---|---|---|
| Toner No. 5 | 18.5 | 18.2 | 1.5 |

As shown in the above result, the rate of change of Q/M of the presented toner particles comprising β-form Cu-phythalocyanine under change of environmental coditions is very small compared with the toner comprising α-form Cu-phythalocyanine.

EXAMPLE 6

Toner composition of Toner No. 6

| Component | parts by weight |
|---|---|
| Binder resin: | 86.5 |
| copolymer of styrene-n-buthylmethacrylate | |
| Quternary anmonium salt: | 0.5 |

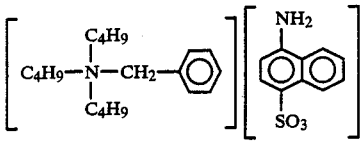

| | |
|---|---|
| β-form Cu-phythalocyanine: | 3.0 |
| Fastogen Blue FGF | |
| (made by DainihonInk Co., Tokyo, Japan) | |
| Carbonblack: | 10.0 |
| Carbonblack #44 | |
| (made by Mitsubishi Kaseio, Tokyo, Japan) | |

By the same procedures as in the case of the Toner No. 1, toner particles of the above composition were prepared (Toner No. 6).

With the use of the above mentioned toner particles, the environment dependency of the triboelectrical chargeability of toner particles was measured by the same way as Example 1, and results of measurement were as follows.

| Toner No. | Q/M(μcoulomb/g) 10° C. and 20% RH | 30° C. and 85% RH | Rate of Change of Q/M (%) |
|---|---|---|---|
| Toner No. 6 | 18.5 | 17.9 | 2.8 |

As shown in the above result, the rate of change of Q/M of the presented toner particles comprising β-form Cu-phythalocyanine to the change of environmental coditions is very small.

EXAMPLE 7

| Toner composition of Toner No. 7 | |
|---|---|
| Component | parts by weight |
| Binder resin: copolymer of styrene-n-buthylmethacrylate | 87.5 |
| Quternary anmonium salt: | 2.0 |
| 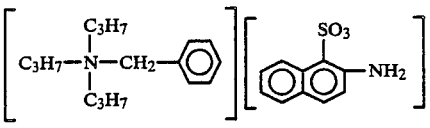 | |
| β-form Cu-phythalocyanine: No. 700-8FG Cyanine Blue (made by ToyoInk Co., Tokyo, Japan) | 0.5 |
| Carbonblack: Carbonblack #44 (made by Mitsubishi-Kasei, Tokyo, Japan) | 10.0 |

By the same procedures as the Toner No. 1, toner particles of the above composition were prepared (Toner No. 7).

With the the use of Toner No. 7, the environment dependencey of the triboelectrical chargeability of toner particles was measured by the same way as Example 1, and results of measurements were as follows.

| Toner No. | Q/M(μcoulomb/g) 10° C. and 20% RH | 30° C. and 85% RH | Rate of Change of Q/M (%) |
|---|---|---|---|
| Toner No. 7 | 26.9 | 26.2 | 2.5 |
| Comparative Toner No. 7 | 27.3 | 15.6 | 43.0 |

As shown in the above result, the rate of change of Q/M of the presented toner particles comprising β-form Cu-phythalocyanine under to the change of environmental coditions is very small.

EXAMPLE 8

Toner No. 1 and Comparative Toner No. 1 those were produced in Example 1 were prepared. Accoding to a following carrier composition, core materials of carrier particles were coated with a coating solution by a method of a fludized bed, then dried and cured.

| Carrier composition of Carrier No. 1 | |
|---|---|
| Component | Parts by Weight |
| Core material: Irregular shape Iron Oxide Particle (70 μm average particle size) | 100 |
| Coating Solution: | |
| Silicone resin KR250 (made by Shinetsu Chem, Tokyo, Japan) | 20 |
| Toluene | 20 |

With the the use of above mentioned two kinds of toner particles and the carrier particles(Carrier No. 1), the environment dependencey of the triboelectrical chargeability of toner particles was measured by the same method described in Example 1, and results of measurements were as follows.

| Developer No. | Q/M(μcoulomb/g) 10° C. and 20% RH | 30° C. and 85% RH | Rate of Change of Q/M (%) |
|---|---|---|---|
| Toner No. 1 + Carrier No. 1 | 20.1 | 19.5 | 3.0 |
| Comparative Toner No. 1 + Carrier No. 1 | 25.6 | 11.0 | 49.0 |

As shown in the above result, even in a case of using the silicone coated carriers the rate of changes of Q/M of the presented toner particles comprising β-form Cu-phythalocyanine to the change of enviromental coditions is very small compared with the toner comprising α-form Cu-phythalocyanine.

A developer composed by 25 g of the Toner No. 1 particles and 975 g of the Carrier No. 1 was subjected to make copies in which 100,000 were made, as the toner particles were replenished when necessary, by a use of experimental machine in which positive latent images using the organic photoconducter were formed, and of which copying speed was 50 sheets per miniuts. A result was that clear copies were obtained and Q/M was not changed at all during a copy test.

EXAMPLE 9

Toner No. 2 in Example 2 were prepared. According to a following carrier composition, core materials of carrier particles were coated with the coating solution by the same method of Example 8. (Carrier No. 2).

| Carrier Composition of Carrier No. 2 | |
|---|---|
| Component | Parts by Weight |
| Core material: Spherical shape Ferrite Particle (100 μm average particle size) | 100 |
| Coating Solution: | |
| Silicone resin SR2400 (made by Toray Silicone Co. Tokyo, Japan) | 20 |
| Toluene . | 20 |

With the the use of the Toner No. 2 and the carrier particles(Carrier No. 2), the environment dependency of triboelectrical chargeability of toner particles was measured by the same method described in Example 1, and results of measurements were as follows.

| Developer No. | Q/M(μcoulomb/g) 10° C. and 20% RH | 30° C. and 85% RH | Rate of Change of Q/M (%) |
|---|---|---|---|
| Toner No. 2 + Carrier No. 2 | 16.5 | 16.1 | 2.4 |

As shown in the above result, even in a case of using this silicone coated carriers the rate of change of Q/M of the presented toner particles comprising β-form Cu-phythalocyanine to the change of environmental coditions is very small.

In the same way as Example 8, a developer composed by the Toner No. 2 and the Carrier No. 2 was subjected to make 100,000 copies, and a result was that clear copies were obtained and Q/M was not changed at all during the copy test.

EXAMPLE 10

Toner No. 3 in Example 3 were prepared. Accoding to a following carrier composition, and by the same procedures as Carrier No. 1, Carrier No. 3 were prepared.

| Carrier Composition of Carrier No. 3 | |
|---|---|
| Component | Parts by Weight |
| Core material: Spherical shape Ferrite Particle (100 μm average particle size) | 100 |
| Coating Solution: | |
| Silicone resin SR2411 (made by Toray Silicone Co. Tokyo, Japan) | 20 |
| Toluene | 20 |

With the use the Toner No. 3 and the Carrier No. 3, the environment dependency of triboelectrical chargeability of toner particles were measured by the same method described in Example 1, and results of measurementwere were as follows.

| Developer No. | Q/M(μcoulomb/g) 10° C. and 20% RH | 30° C. and 85% RH | Rate of Change of Q/M (%) |
|---|---|---|---|
| Toner No. 3 + Carrier No. 3 | 23.7 | 22.1 | 6.8 |

As shown in the above result, even in the case of using this silicone coated carriers the rate of change of the Q/M of the presented toner particles comprising β-form Cu-phythalocyanine to the change of environmental coditions is very small.

In the same way as Example 8, a developer composed by the Toner No. 3 particles and the Carrier No. 3 was subjected to make 100,000 copies, and a result was that clear copies were obtained and Q/M was not changed at all during the copy test.

EXAMPLE 11

With the the use of Toner No. 5 and the Carrir No. 1, the environment dependency of triboelectrical chargeability of toner particles were measured by the same method described in Example 1, and results of measurement were as follows.

| Developer No. | Q/M(μcoulomb/g) 10° C. and 20% RH | 30° C. and 85% RH | Rate of Change of Q/M (%) |
|---|---|---|---|
| Toner No. 5 + Carrier No. 1 | 20.3 | 18.5 | 2.8 |

As shown in the above result, even in this case the rate of changes of Q/M of the presented toner particles comprising β-form Cu-phythalocyanine to the change of environmental conditions is very small.

In the same way as Example 8, a developer composed by the Toner No. 5 particles and the Carrier No. 1 was subjected to make 100,000 copies, and a result was that clear copies were obtained and the Q/M was not changed at all during the copy test.

EXAMPLE 12

With the the use of Toner No. 4 and the Carrir No. 3 in Example 10, the environment dependency of triboelectrical chargiability of toner particles were measured by the same method described in Example 1, and results of measurement were as follows.

| Developer No. | Q/M(μcoulomb/g) 10° C. and 20% RH | 30° C. and 85% RH | Rate of Change of Q/M (%) |
|---|---|---|---|
| Toner No. 4 + Carrier No. 3 | 23.9 | 22.6 | 5.5 |

As shown in the above result, even in this case the rate of changes of Q/M of the presented toner particles comprising β-form Cu-phythalocyanine to the change of environmental conditions is very small.

In the same way as Example 8, a developer composed by the Toner No. 4 particles and the Carrier No. 3 was subjected to make 100,000 copies, and a result was that clear copies were obtained and Q/M was not changed at all during the copy test.

As stated above, the toner particles in the present invetion exhibits outstanding durability under various environmental conditions, and by the use of the dveloper composed by the toner particles of the present invention and the carrier particles coated with silicone polymers excellent high images are obtained without the supent phenomenoe of the carriers for long imaging cycles.

What is claimed is:

1. A toner particle of a two component dry-type developer capable of being charged positively comprises (a) a binder resin; (b) quaternary ammonium salt represented by the following formula (1)

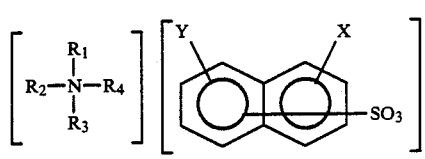

(I)

Wherein $R_1$ is $C_1$–$C_8$ alkyl or benzyl, $R_2$ and $R_3$ are each $C_1$–$C_{18}$ alkyl, R is $C_1$–$C_{18}$ alkyl or benzyl, X is hydroxy or amino, and Y is hydoroxy or hydrogen; (c) β-form Cu-phthalocyanine; and (d) carbonblack.

2. A toner particle as defined in claim 1 which comprises 0.05 to 10 parts by weight of quaternary ammonium salt repsented by the formula (I), 0.1 to 5 parts by weight of β-form Cu-phthalocyanine, 1 to 15 parts by weight of carbonblack and 100 parts by weight of binder resins.

3. A toner particle of claim 1 wherein said quaternary ammonium salt is represented by the following formula

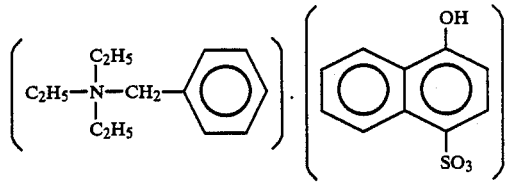

4. A toner particle of claim 1 wherein said quaternary ammonium salt is represented by the following formula

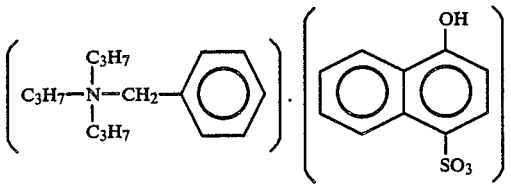

5. A toner particle of claim 1 wherein said quaternary ammonium salt is represented by the following formula

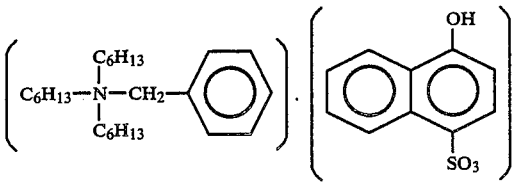

6. A toner particle of claim 1 wherein said quaternary ammonium salt is represented by the following formula

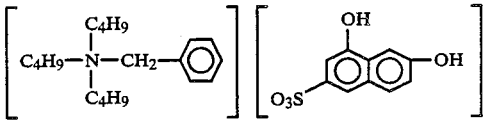

7. A toner particle of claim 1 wherein said quaternary ammonium salt is represented by the following formula

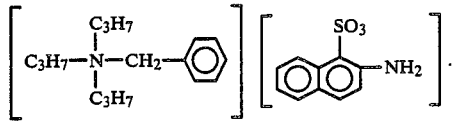

8. A toner particle of claim 1 wherein said quaternary ammonium salt is represented by the following formula

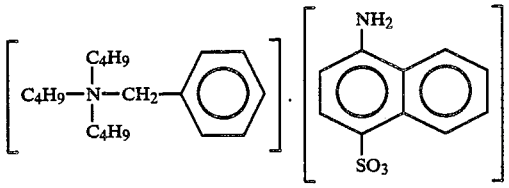

9. A toner particle of claim 1 wherein said β-form Cu-phthalocyanine is the C.I. Pigment Blue 15:3 in the Colour Index Table.

10. Toner particles of claim 1 wherein said β-form Cu-phthalocyanine is the C.I. Pigment Blue 15:4 in the Colour Index Table.

11. A toner particle of claim 1 wherein an electrical resistiviy of said carbon black is $10^3$ to $10^6$ Ω-cm.

12. A developer composition composed by toner particles and carrier particles, said toner particles comprising (a) a binder resin; (b) a quaternary ammonium salt compound represented by the following formula (I)

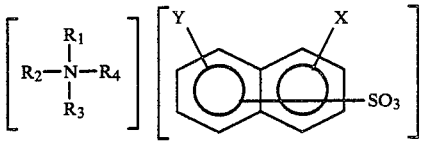

(I)

wherein $R_1$ is $C_1$–$C_8$ alkyl or benzyl, $R_2$ and $R_3$ are each $C_1$–$C_{18}$ alkyl, R is $C_1$–$C_{18}$ alkyl or benzyl, X is hydroxy or amino, and Y is hydoroxy or hydro-gen; (c) β-form Cu-phthalocyanine; (d) carbonblack.

13. A developer composition of claim 12 wherein said carrier particles are overcoated with silicone resins.

* * * * *